US006781047B1

(12) United States Patent
Calanni

(10) Patent No.: US 6,781,047 B1
(45) Date of Patent: Aug. 24, 2004

(54) MUSICAL INSTRUMENT STORAGE AND/OR CARRYING CASE

(76) Inventor: Bernard P. Calanni, 50 Wilson Ave., Matawan, NJ (US) 07747

( * ) Notice: Subject to any disclaimer, the term of this patent is extended or adjusted under 35 U.S.C. 154(b) by 0 days.

(21) Appl. No.: 10/395,597

(22) Filed: Mar. 25, 2003

(51) Int. Cl.[7] ..... G10G 3/00
(52) U.S. Cl. ..... 84/453
(58) Field of Search ..... 84/453, 327, 329, 84/421

(56) References Cited

U.S. PATENT DOCUMENTS 3,707,897 A * 1/1973 Hertz ..... 84/479 R
4,406,707 A * 9/1983 Moore et al. ..... 134/4
5,496,179 A * 3/1996 Hoffman ..... 434/433
5,866,249 A * 2/1999 Yarusso et al. ..... 428/41.8

FOREIGN PATENT DOCUMENTS

GB 2195814 A * 4/1988 ..... A63H/5/00

OTHER PUBLICATIONS

Soma Shigeru, JP2000338967, Case for a Musical Instrument and Manufacture.*

* cited by examiner

*Primary Examiner*—Kimberly Lockett
(74) *Attorney, Agent, or Firm*—Charles I. Brodsky

(57) ABSTRACT

A musical instrument storage and/or carrying case including a musical instrument case having a depiction on the case of the musical instrument stored within, adhesively secured to at least one of its top and bottom defining sides.

15 Claims, 6 Drawing Sheets

MUSICAL INSTRUMENT STORAGE AND/OR CARRYING CASE

CROSS-REFERENCE TO RELATED APPLICATIONS

NONE

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

NOT APPLICABLE

BACKGROUND OF THE INVENTION

1. Field of the Invention

This invention relates to musical instrument cases, in general, and to a musical instrument storage and/or carrying case, in particular.

2. Description of the Related Art

As is well known and understood, musical instrument storage and/or carrying cases range in size from the very small (such as for harmonicas) to the very large (such as for xylophones). As is also well known, in the manufacture and construction of these musical instrument cases, the primary concern is one of a trade-off between the making of a case sufficiently strong to protect the instrument within and the prices at which the purchaser of such cases would reasonably be willing to pay. Little, if any, thought is given to the aesthetics or overall appearance of the case, or exactly how one case might be distinguishable from the next when housing the same type of instrument. As a result, those musical instrument cases generally available are commonly of a plain, drab color—frequently leading to one musician of an orchestra mistaking his/her case for that of another musician playing the same instrument.

As will become clear from the following description, these problems are overcome and obviated by the teachings of the present invention.

SUMMARY OF THE INVENTION

As will be seen from the description below, a musical instrument storage and/or carrying case embodying the invention includes a musical instrument case having opposing top and bottom sides, with the musical instrument case being closable upon bringing the two sides together in abutting position, and with the musical instrument case being openable upon separating the two sides one from another. While most musical instrument cases include such feature, the musical instrument storage and/or carrying case of the invention goes further by having a depiction on the case of the musical instrument stored inside, as an adhesive securement to at least one of its top and bottom sides.

In accordance with a preferred construction of the invention, the depiction of the musical instrument is one that is substantially full sized, and comprises an adhesive backed decal. Intended to be resistant to adverse weather conditions (since the musical instrument case at least at some point of time will be carried outdoors), the adhesive backed decal of the invention is preferably composed of a vinyl material. To differentiate one musician's case from another, furthermore, the vinyl decal could be colored, or could afford a 3-dimensional depiction of the musical instrument stored in the case, or both. With at least one carry handle included along an outside surface of the instrument case, a preferred embodiment of the invention could be one in which the vinyl decal is adhesively secured to each of its top and bottom sides. With an adhesive securement, moreover, the vinyl decal can be peeled off the case if so desired, to be replaced at a later date—useful, for example, where the musician changes from one design-of a-carried electric guitar, to another design and wishes the depiction to be that of the type of guitar then being stored and/or carried within his/her case.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE INVENTION

FIGS. 1–7 show several designs for musical instrument cases 10 having opposing top and bottom sides 14, 16 respectively—each with one or more carry handles 18 along their outside surfaces. As will be understood, bringing the two sides 14, 16 together allows for the closing of the case, while separating the two sides 14, 16 away from one another allows for the opening of the case for placing the instrument inside or removing it from the case itself.

Figure 1:
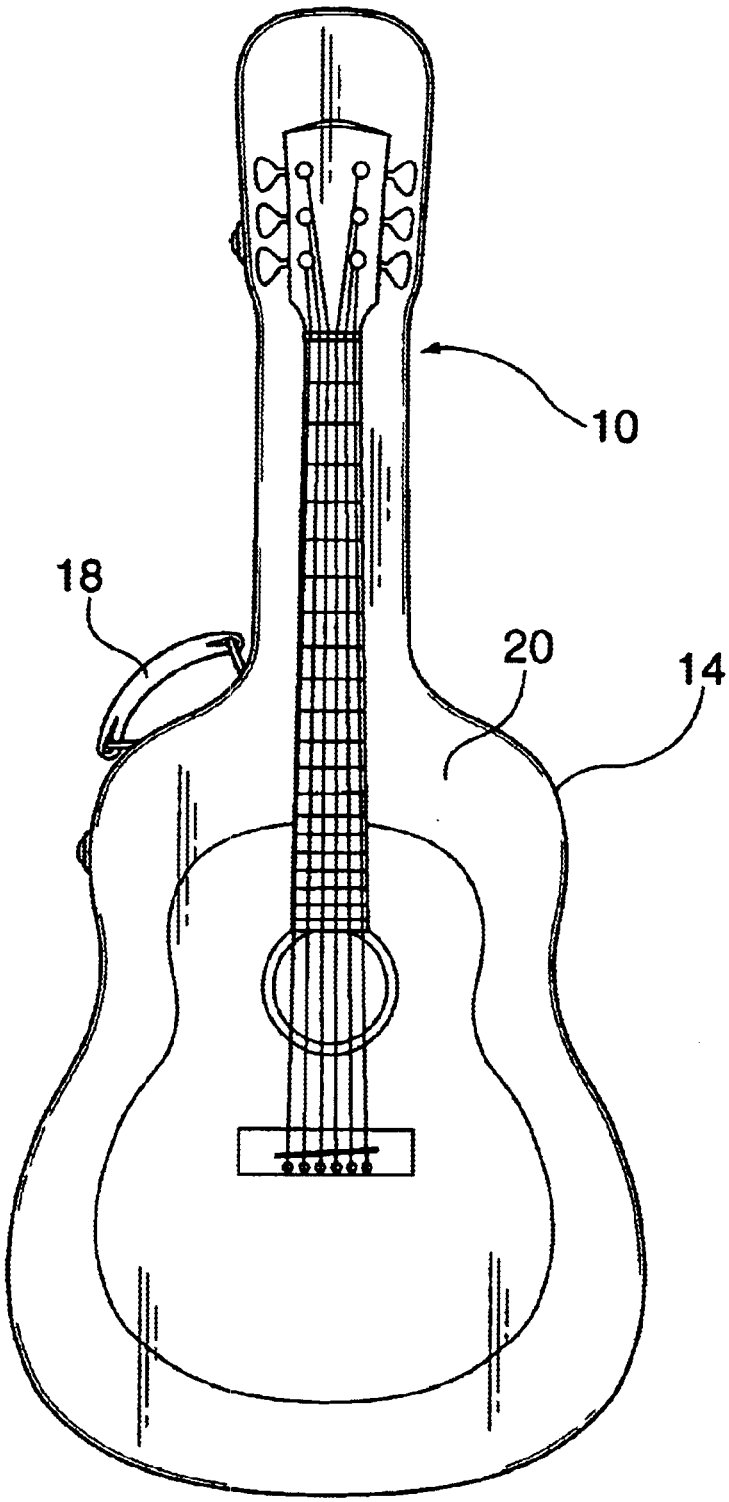
FIGS. 1–7 are illustrations of various musical instrument storage and/or carrying cases according to the invention.
Figure 2:
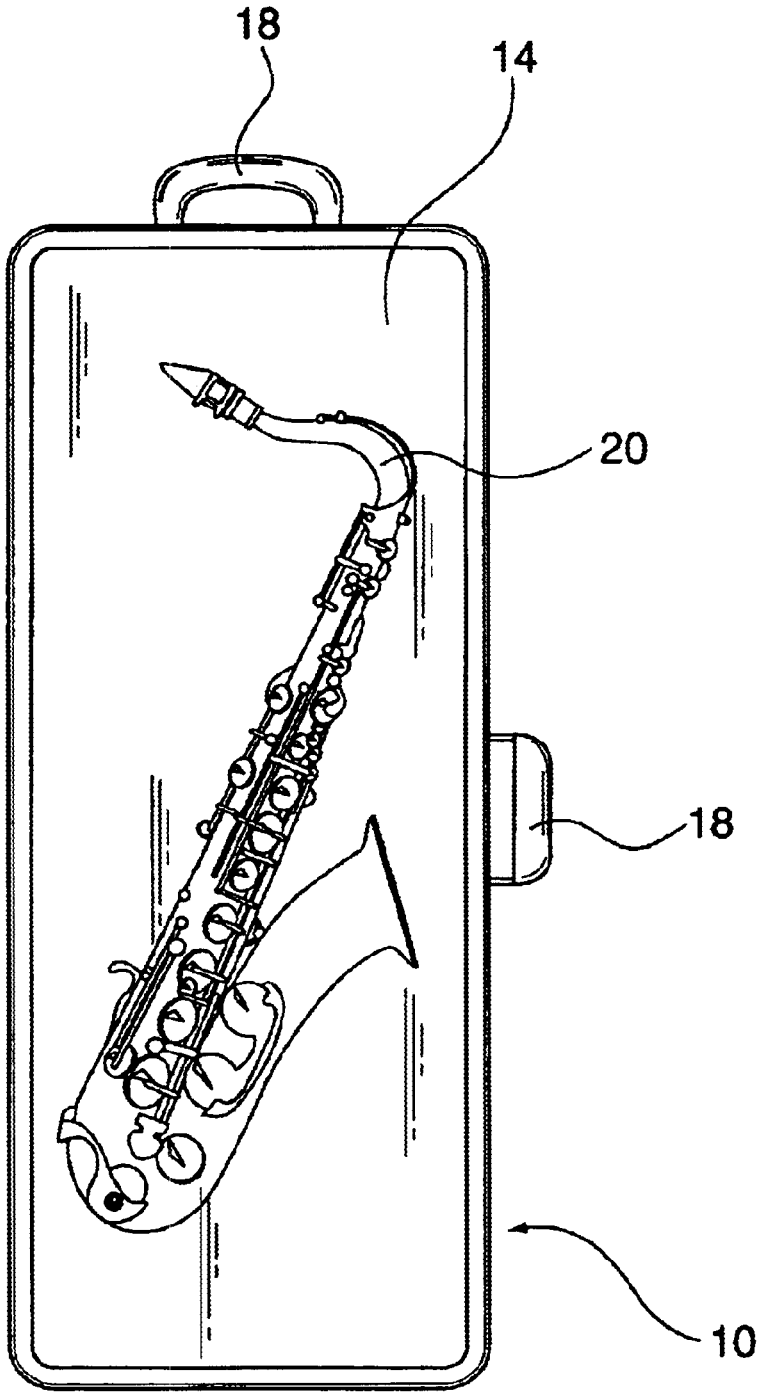

In accordance with the invention, each of the cases 10 of FIGS. 1–7 includes a depiction of a musical instrument stored within—shown at 20 and understood as being adhesively secured to at least one of the top and bottom sides 14, 16. In FIG. 1, for example, the depiction is of an acoustic guitar; in FIG. 2, the depiction is of a saxophone; in FIGS. 3 and 4, the depiction 20 is of an electric guitar; while in FIGS. 5, 6 and 7, a violin, a trumpet and a banjo are respectively shown. The instrument case 10 of FIG. 2 is shown with two carry handles 18, while those of FIGS. 1 and 3–7 only include one such handle. In preferred embodiments of the invention, the depictions 20 not only are of the musical instrument stored in the case, but such depictions are substantially full-sized. Although not observable as such, comparable depictions as 20 may be adhesively secured to the opposite side of the musical instrument cases 10 as shown.

Figure 3:
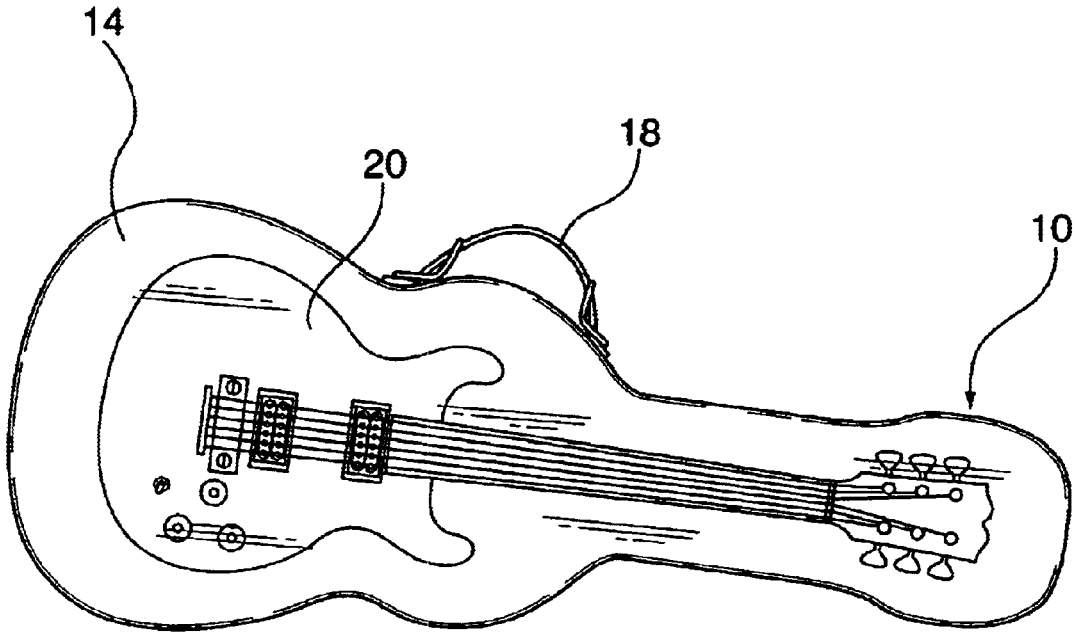
Figure 4:
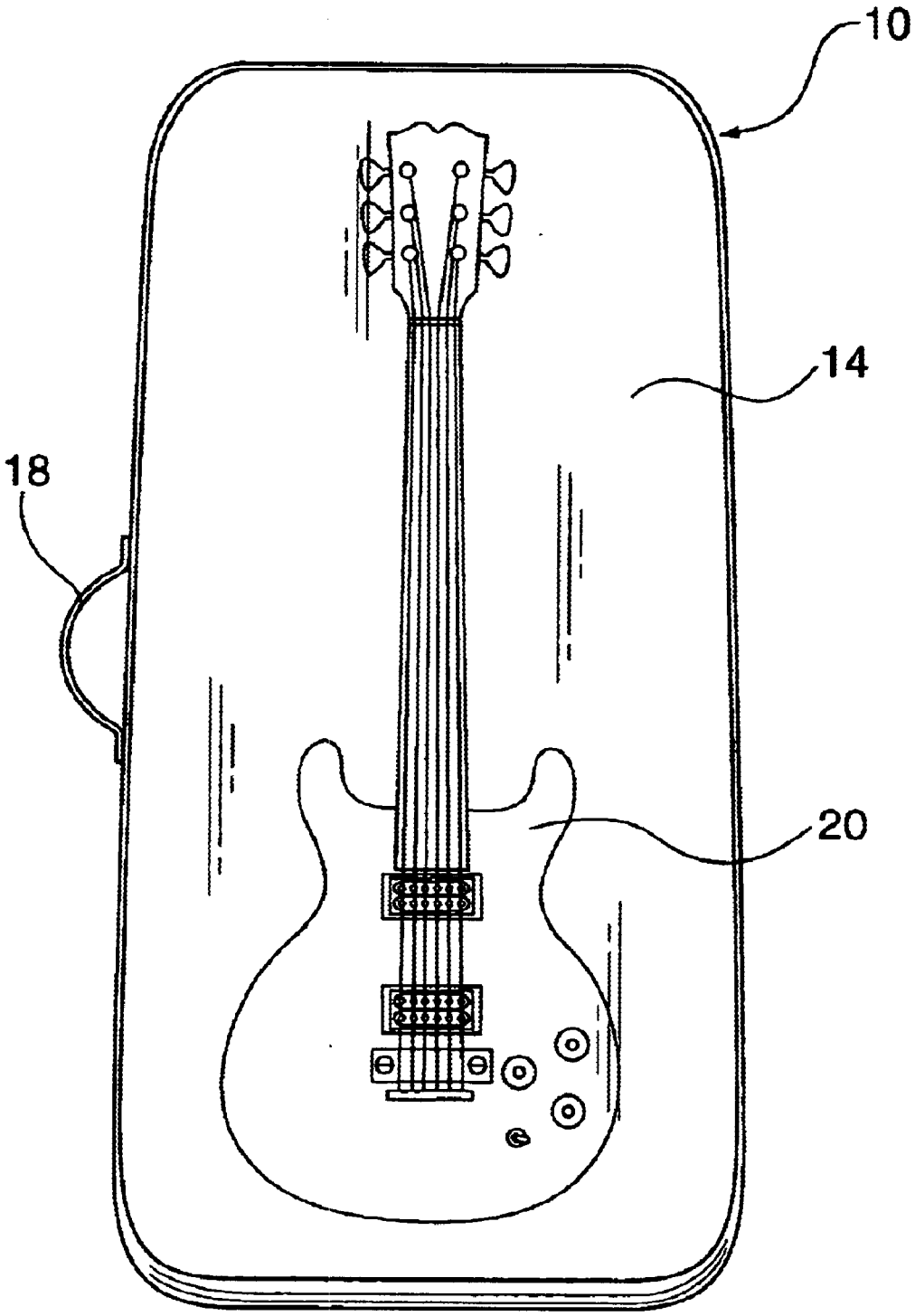
Figure 5:
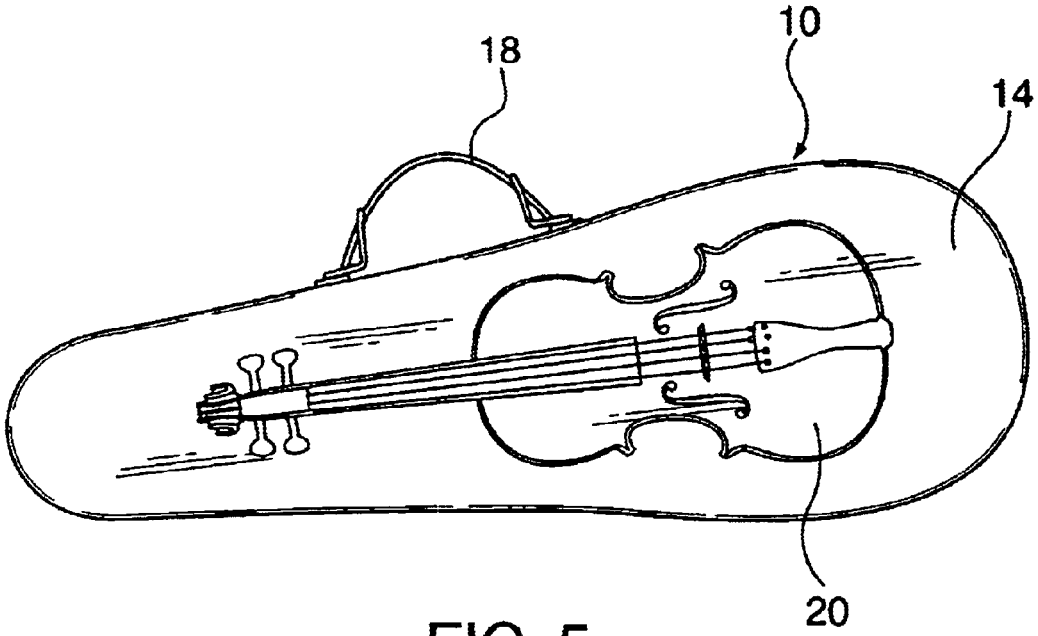
Figure 6:
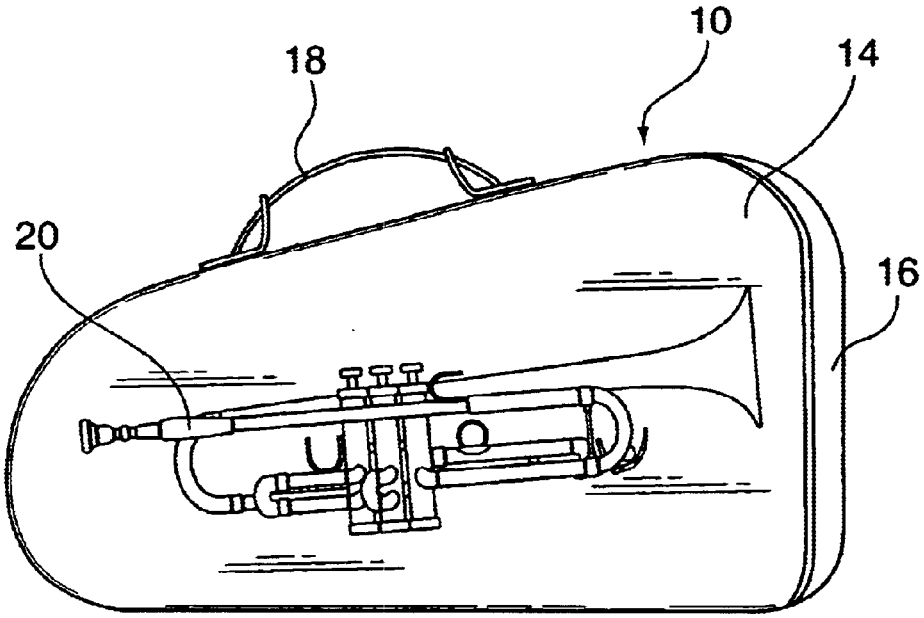
Figure 7:
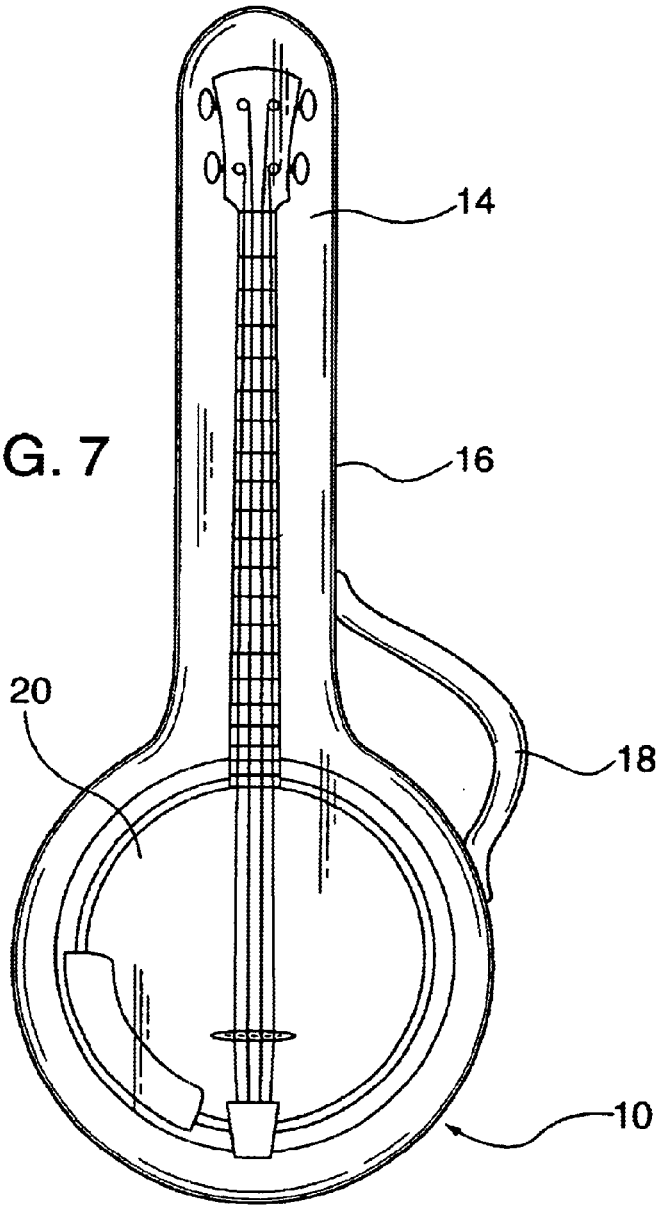
Figure 8A:
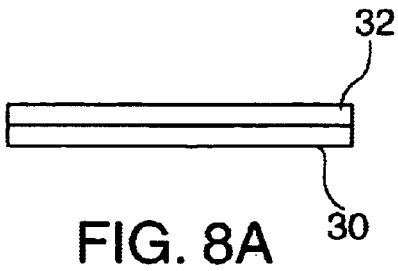
FIGS. 8A and 8B are side views of an adhesive backed decal depiction of the musical instruments to be secured to the instrument case itself.
Figure 8B:
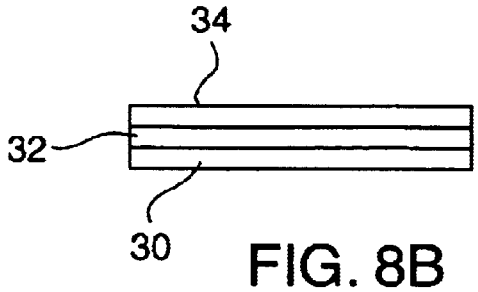

FIGS. 8A and 8B illustrate side views of depictions of the type to be secured to at least one of the top and bottom sides of the musical instrument cases of FIGS. 1–7. As shown, the depiction is that of an adhesive backed decal—with the adhesive layer being shown at 30 and with the decal being shown at 32. Such decal 32 is of a composition resistant to weather so as to be able to be carried outdoors, and preferably is of a vinyl composition. To provide a pleasing aesthetic appearance, the decal 32 may be colored, or monochromatic, as desired. In separate constructions of the invention, for example, the acoustic guitar decal for FIG. 1 was selected primarily white with shades of grey. In FIG. 3, a wood-shaded tone coloration was provided for the electric guitar decal, while in FIG. 4, a turquoise coloration was provided. A gold-tone finish was afforded the decal for the saxophone of FIG. 2, as being that coloration for the instrument housed within the case—to be contrasted with a musical instrument case having a silver-toned saxophone stored within. FIG. 8B goes further in incorporating a third layer 34 for providing a 3-dimensional effect to the decal depiction.

In a preferred embodiment of the invention, a 2-dimensional vinyl decal may be employed as the stick-on graphic depiction of the musical instrument stored in the case 10, with its adhesive layer 30 of a type that could later be peeled from the top or bottom side 14, 16, in those instances where one desires to replace the instrument stored and/or carried within the case—and wishes to substitute a type of decal depiction more appropriate for the instrument then placed within. With the invention as described, analysis has shown that depictions of these types could be attractively priced in the range of $25.00–$35.00 for sale when of full-size, and be attractive to members of the purchasing public at such cost. Obviously, for smaller size depictions, the cost to the purchasing public could be reduced accordingly.

While there have been described what are considered to be preferred embodiments of the present invention, it will be readily appreciated by those skilled in the art that modifications can be made without departing from the scope of the teachings herein. For at least such reason, therefore, resort should be had to the claims appended hereto for a true understanding of the scope of the invention.

I claim:

1. The combination comprising:

a musical instrument case to store a particular musical instrument within, said case having opposing top and bottom sides, with said instrument case being closable upon bringing said two sides together in abutting position and being openable upon separating said two sides one from another;

and a depiction of said musical instrument to be a stored in said case, said depiction being adhesively secured to at least one of said top and bottom sides.

2. The combination of claim 1 wherein said depiction is of said musical instrument as stored in said case substantially full sized.

3. The combination of claim 2 wherein said depiction is an adhesive backed decal.

4. The combination of claim 2 wherein said depiction is an adhesive backed weather resistant decal.

5. The combination of claim 2 wherein said depiction is an adhesive backed vinyl decal.

6. The combination of claim 5 wherein said vinyl decal is colored.

7. The combination of claim 5 wherein said vinyl decal affords a 3-dimensional depiction of said musical instrument as stored in said case.

8. The combination of claim 5 wherein said musical instrument case also includes at least one carry handle along an outside surface thereof.

9. The combination of claim 8 wherein said vinyl decal is adhesively secured to each of said top and bottom sides of said musical instrument case.

10. The combination of claim 2 wherein said depiction is a stick-on graphic.

11. The combination comprising:

a musical instrument case having opposing top and bottom sides, with said instrument case being closable upon bringing said two sides together in abutting position and being openable upon separating said two sides one from another;

and a depiction of a musical instrument stored in said case, said depiction being adhesively secured to at least one of said top and bottom sides;

wherein said depiction is an adhesive backed vinyl decal; and wherein said vinyl decal affords a 3-dimensional depiction of the musical instrument stored in said case.

12. The combination comprising:

a musical instrument case having opposing top and bottom sides, with said instrument case being closable upon bringing said two sides together in abutting position and being openable upon separating said two sides one from another;

and a depiction of a musical instrument stored in said case, said depiction being adhesively secured to at least one of said top and bottom sides;

wherein said depiction is an adhesive backed vinyl decal;

wherein said musical instrument case also includes at least one carry handle along an outside surface thereof; and wherein said vinyl decal is adhesively secured to each of said top and bottom sides of said musical instrument case.

13. The combination of claim 12 wherein said depiction is of said musical instrument as stored in said case substantially full sized.

14. The combination of claim 12 wherein said depiction is an adhesive backed weather resistant decal.

15. The combination of claim 12 wherein said vinyl decal is colored.

* * * * *